United States Patent [19]

Leong

[11] Patent Number: 4,500,072

[45] Date of Patent: Feb. 19, 1985

[54] LOW PROFILE JACK CONSTRUCTION

[75] Inventor: David S. Leong, Lincolnwood, Ill.

[73] Assignee: Templeton Kenly & Company, Broadview, Ill.

[21] Appl. No.: 430,106

[22] Filed: Sep. 30, 1982

[51] Int. Cl.[3] ..... B66F 3/00

[52] U.S. Cl. ..... 254/95; 74/412 TA

[58] Field of Search ..... 254/1, 95–97; 74/412 TA, 89.15

[56] References Cited

U.S. PATENT DOCUMENTS

| | | | |
|---|---|---|---|
| 556,625 | 3/1896 | Gilchrist | 254/95 |
| 1,475,057 | 11/1923 | Ellingsen . | |
| 1,706,361 | 3/1929 | Newkirk | 254/96 |
| 1,805,879 | 5/1931 | McKenny . | |
| 3,435,695 | 4/1969 | Rivers | 74/412 TA |
| 3,466,011 | 9/1969 | Mewes et al. | 254/97 |

FOREIGN PATENT DOCUMENTS

| | | |
|---|---|---|
| 438432 | 9/1925 | Fed. Rep. of Germany . |
| 437649 | 1/1926 | Fed. Rep. of Germany . |
| 437105 | 1/1926 | Fed. Rep. of Germany . |
| 471889 | 1/1927 | Fed. Rep. of Germany . |
| 812356 | 8/1949 | Fed. Rep. of Germany . |
| 1146088 | 10/1963 | Fed. Rep. of Germany . |

*Primary Examiner*—Robert C. Watson

*Attorney, Agent, or Firm*—Neuman, Williams, Anderson & Olsen

[57] ABSTRACT

A mechanical jack construction is provided comprising a load-bearing rack which is adapted to be moved in the vertical plane by an engaging pinion. The pinion is connected to a lever-driven ratchet wheel by means of shear pins. Application of an excessive load to the load-bearing rack will result in fracture of the shear pins, disengagement of the pinion from the ratchet wheel and substantially instantaneous lowering of the rack. Such construction lends itself to use in track repair and similar applications in which immediate jack retraction is desired upon engagement of excessive loads.

13 Claims, 7 Drawing Figures

LOW PROFILE JACK CONSTRUCTION

This invention relates to a jack construction, and more particularly pertains to a low profile jack construction particularly adapted for use in the repair of track for railroads. The provided jack construction has incorporated therein a novel safety feature which assures the absence of train derailment and equipment damage in the normal course of use.

Jacks employed in the railway systems throughout the world must be possessed of certain requisites when employed for track repair. The jacks must be lightweight so as to be readily placed by a workman in desired position relative to a rail to be elevated. The jacks must preferably also be of a desired low profile to not only be readily insertable under a rail to be elevated with a minimum of effort, but also to provide a profile in the collapsed condition which is small enough so as not to be struck in the event a train passes over the rail engaged thereby. Still further it is desired that the collapsed jack be able to stay in place in a rail-engaging position without permanent damage being inflicted thereon as a train passes thereover.

To prevent jack damage, the jack must also be readily collapsible so as not to be subjected to the full weight of the train passing over the jack supported rail. Such readily collapsibility also facilitates removal of the jack from a use site after the desired track elevation has been completed in the normal course of jack use.

Jacks of the type hereinafter described are normally mechanically actuated as distinguished from hydraulically operated jacks. The fluid flow in the latter jacks prevents desired rapid jack collapse so as to prevent train derailment in the event an elevated rail supported thereby is approached by a speeding train.

The prior art discloses various mechanical jack constructions in which a driving pawl is lever actuated to rotate a ratchet wheel which is rotatable with a pinion engaging a rack. The driven rack has mounted thereon a rail-engaging ledge or toe which is insertable under a rail. Rotation of the ratchet wheel by a workman so as to simultaneously rotate the pinion effects an elevation of the rack, attached toe and rail supported thereon.

In the event a train unexpectedly and suddenly approaches the site of such jacks of the prior art, unless the jack is immediately collapsed, the jack comprises an obstacle which when struck by the moving train could result in train derailment. This is particularly true if a plurality of jacks are employed in a rail repair operation so as to provide a series of obstacles to be engaged by the moving train.

In accordance with the novel jack construction of this invention, pins designed to fail in shear at a predetermined load comprise a safety release which allows substantially instantaneous collapse of the jack upon pin failure. Such failure occurs prior to the train being disposed in the immediate vicinity of the jack, as the train weight transmitted through a rail length will result in pin failure prior to disposition of the train immediately over the jack. As a result the jack will be in a collapsed, low-profile condition at the instant the train is passing thereover. As a consequence, the collapsed jack will not provide an obstacle to be contacted by the train, eliminating any danger of derailment. Such jack collapse occurs automatically without the need for any workman to be present.

Also, the provided jack is so constructed that shear pin failure prevents damage to any jack component enabling the same to be reused upon insertion of new shear pins.

An example of a prior art jack construction employing a driven ratchet wheel and connected pinion and rack assembly is that manufactured by Robel and Co. of Munich, Germany. Such jack constructions differ from that of this invention hereinafter described in detail in that they must be released from an elevated position by actuation by a workman stepping on a release pedal. There is no automatic release of the elevated jack by the weight of the approaching train. Accordingly, in the event a workman has left the jack unattended or panics at approach of an oncoming speeding train, neglecting to release the jack into its collapsed position, the danger is present that the jack in the elevated position will result in derailment of the oncoming train. In addition, this prior art jack has a relative disposition between the elevating pinion and rack assembly which is the reverse of that found in the jack of this invention which renders applications of the elevating force nonuniform with increasing jack height.

Another jack of the prior art which is similar in construction is that sold under the tradename Elephant.

It is thus an object of this invention to provide a low profile jack construction particularly adapted for use in track repair which automatically retracts into the lowered position with the weight of the approaching train, requiring no human agency to effect such retraction. As a result, train derailment resulting from disposition of the jack in the elevated position is obviated.

It is an object of this invention to provide a low profile jack construction which although light in weight is able to support ten tons with safety to a vertical lift of six inches.

It is yet another object of this invention to provide a mechanical jack construction which is particularly adapted for use in rail repair, requiring a minimum of handle effort even at jack capacity by virtue of the novel linkage arrangement and resulting mechanical advantage provided.

It is another object of this invention to provide a jack construction in which the elevating pinion axis and engaging lifting gear sector axis are stationary, resulting in ease of lifting force application because of the nonshifting lever pivot.

It is a further object of this invention to provide a jack construction which is automatically collapsible without the need of human agency as a result of a failure of shear pins incorporated therein. Such failure effects a substantially instantaneous jack collapse thereby obviating damage to any jack element. As a result, the jack may be again readily placed in use by the mere replacement of shear pins which are readily available and of small expense. As the jack collapses prior to the train being disposed thereover, the rail is in the lowered, ground-supported condition, preventing derailment.

In one embodiment of the provided jack construction a base member has pivotally mounted thereon a track engaging toe member adapted to be elevated in the vertical plane. The toe is supported on a curved rack member driven by a pinion which is simultaneously rotatable with a lever-driven ratchet wheel. A shear pin assembly interconnects the driven ratchet and the rotating pinion so that they are simultaneously rotatable along a common axis. However, when a shear force resulting from the weight supported by the lifting toe exceeds the shear pin strength, the shear pins will fail. Such failure results in substantially instantaneous movement of the lifting toe into the retracted positiion. Such shear pin failure is occasioned by the weight of an oncoming train which is transmitted to the rail supported by the lifting toe prior to the train reaching the immediate vicinity of the jack. As a result, the jack will be in the collapsed position presenting no derailment obstacle as the train passes thereover as will hereinafter be explained in greater detail.

For a more complete understanding of this invention reference will now be made to the drawing wherein FIG. 1 is a perspective view of one embodiment of a low profile jack made in accordance with this invention;

Figure 1:
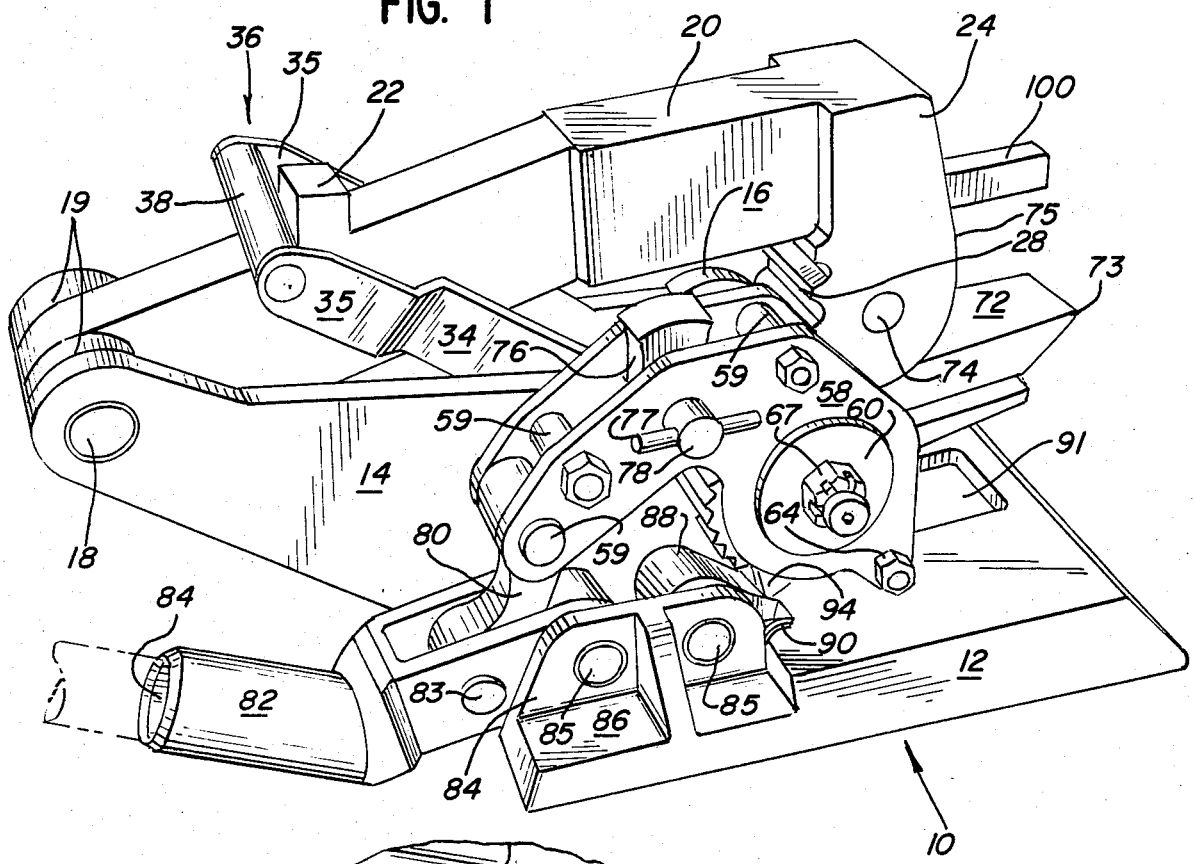

Reference will now be made to FIG. 1 wherein a jack 10 made in accordance with this invention is illustrated comprising a base 12 which is preferably integrally formed as by casting with opposed parallel mounting walls 14 and 16. A pin 18 traverses the two walls and is illustrated at the left end portions of the walls. Spacers 19 engage pin 18 between walls 14–16. Pivotally mounted between the walls and traversed by pin 18 is arm 20 sandwiched between spacers 19 and having a stop boss 22 formed on an upper edge surface thereof. Supported at the right end limit of arm 20 as illustrated in FIG. 1 is curved rack portion 24 which may be integrally formed with the arm. Teeth 28 disposed on the inner surface of rack 24 and more clearly seen in FIG. 2 are adapted to engage mating teeth 30 of pinion 32 seen more clearly in FIG. 2.

Opposed parallel arms 34 of handle 36 are pivotally mounted on pin 96 (FIG. 3) traversing walls 14–16, and may slidably engage the opposed inner surfaces of such walls 14 and 16 of the jack 10.

Figure 3:
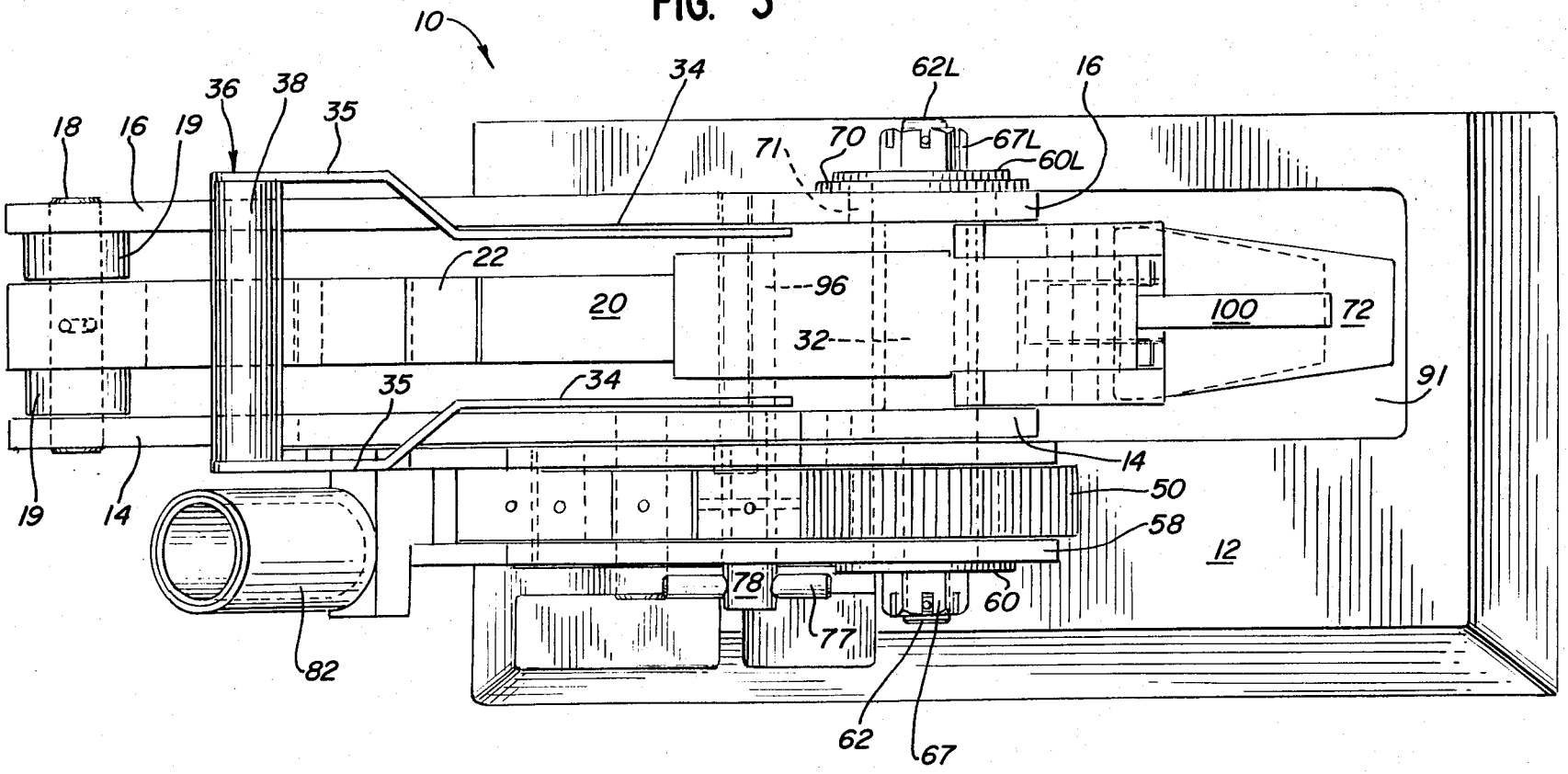
FIG. 3 is a top plan view of a lifting jack made in accordance with this invention.

As is more clearly seen in FIG. 3, the handle 36 comprises the means whereby a workman may grasp bail portion 38 secured to terminal arm portions 35 offset from arm portions 34 and carry the entire jack assembly. The entire jack is preferably designed to weigh approximately fifty pounds so as to be easily handled by a single workman in the field. Bail 38 of the handle 36 also functions to perform a stop function terminating lifting action of the jack 10 by engaging boss 22 as will hereinafter be made more apparent in describing the jack operation.

Figure 2:
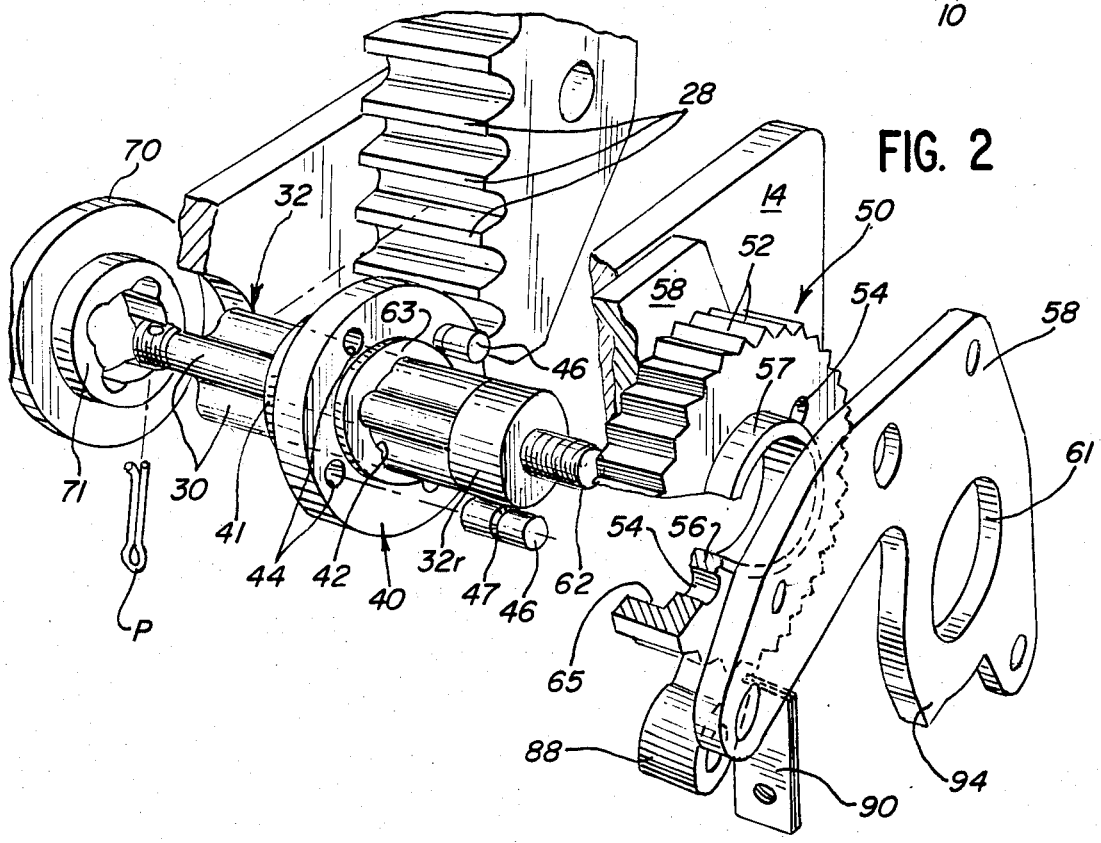
FIG. 2 is a fragmentary exploded perspective view illustrating main lifting pinion and associated elements employed in the jack of this invention.
Figure 6:
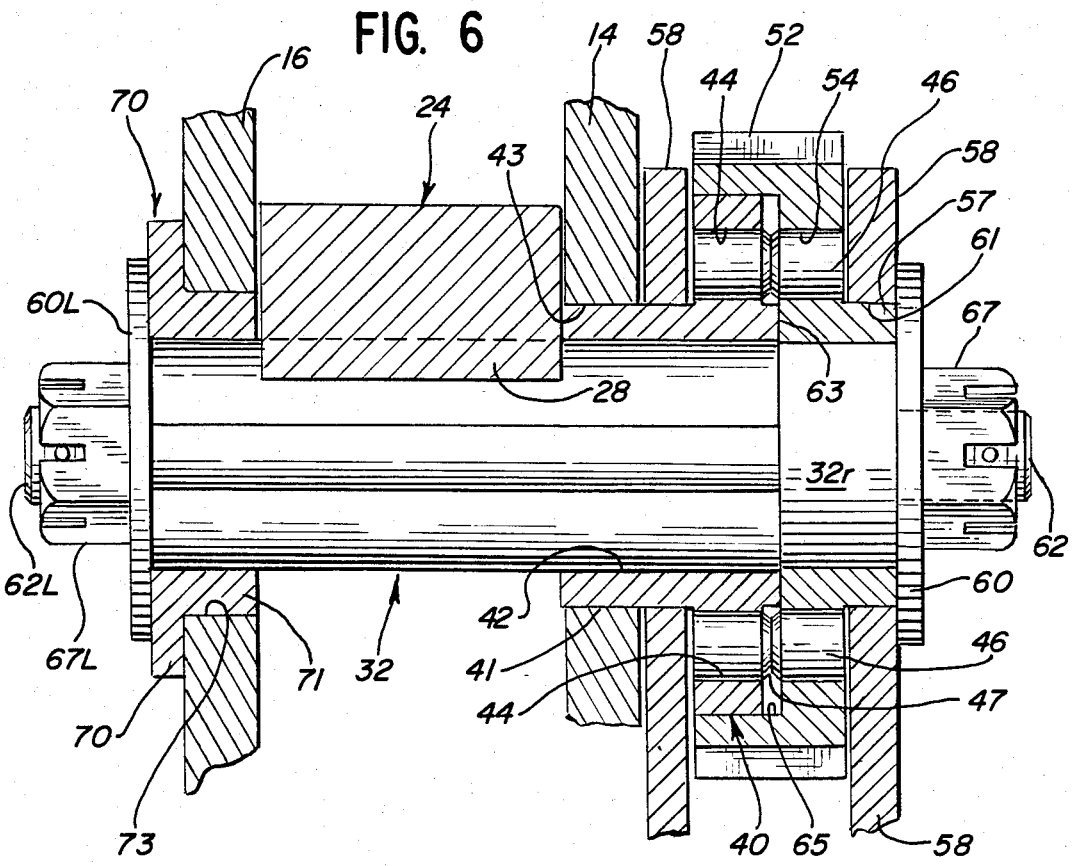
FIG. 6 is a sectional view, partly in elevation, of the jack pinion, lifting rack and ratchet wheel illustrating the manner of shear pin connection between the ratchet wheel and pinion.
Figure 7:
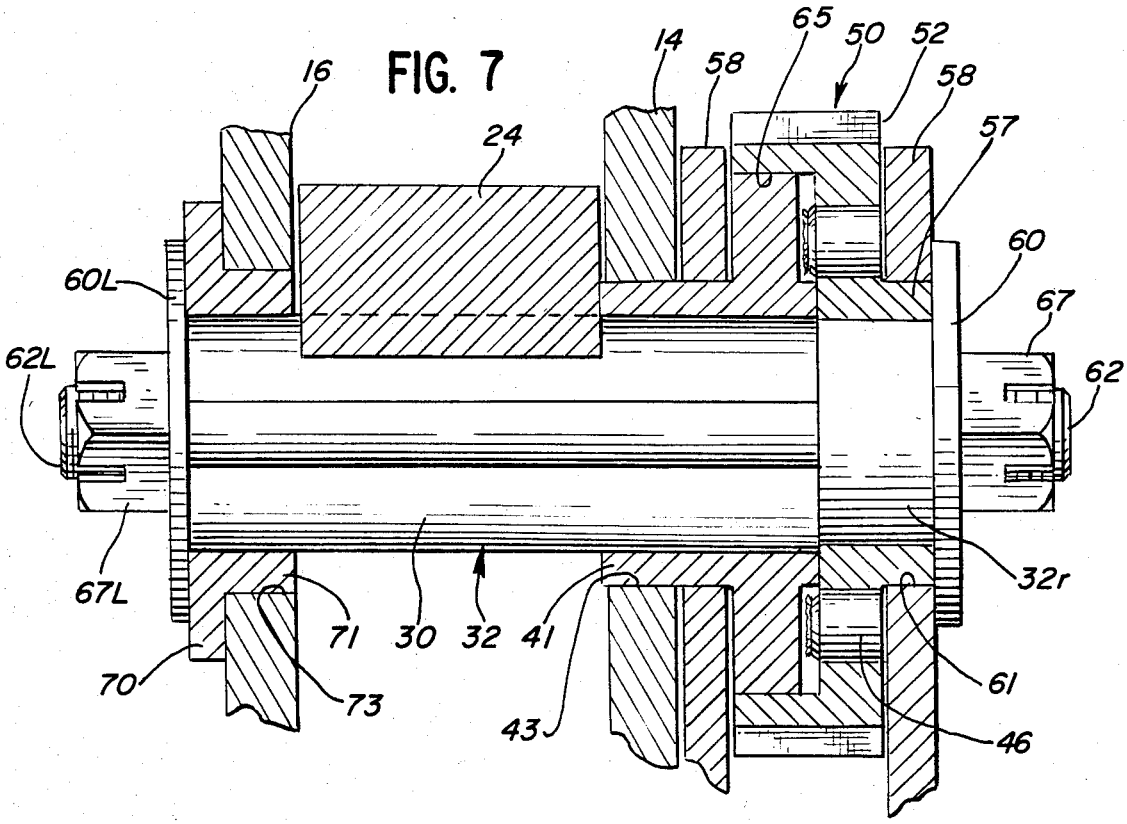
FIG. 7 is a sectional view partly in elevation similar to FIG. 6 illustrating relative disposition between the ratchet wheel and pin of FIG. 6 after the shear pins have fractured and sheared.

Rotatable with pinion 32 is a pinion pin-mounting and bearing plate 40 more clearly seen in FIG. 2 which is centrally cut out at 42 for purposes of matching the outer periphery of teeth 30 of pinion 32 as illustrated in the assembled view of FIG. 2. Plate 40 is slidably mounted on the pinion periphery and has a projecting bearing hub portion 41 (FIG. 2) which engages a receiving opening 43 in the support plate 14 as seen in FIGS. 6, 7. Thus the plate 40 is keyed to the pinion 32 so as to rotate the rewith. Plate 40 has equally spaced about the outer periphery thereof four openings 44 intended to receive as by a press fit or the like, notched shear pins 46 therein, one shear pin 46 being illustrated in place in FIG. 2 in plate 40. A second shear pin 46 is illustrated in FIG. 2 in spaced relationship with a plate opening 44 in which such pin is intended to be received. It will be noted that each shear pin 46 has an annular notch 47 comprising a zone of weakness thereon which the pins 46 are adapted to fail in shear in a manner hereinafter described.

Shear pins 46 comprise an interconnecting means interconnecting pinion 32 with toothed ratchet wheel 50 also illustrated fragmentarily in FIG. 2 and having disposed about the outer periphery thereof teeth 52. Wheel 50 has disposed through the thickness thereof pin-receiving apertures 54. Pins 46 may be received in openings 54 in a substantially precise fit. Wheel 50 is mounted on right end cylindrical portion 32R of pinion 32 by means of an inner wheel sleeve portion 56 which may be integrally formed with and traverses the wheel thickness, see FIGS. 6, 7.

Ratchet wheel 50 is also rotatably mounted on pinion 24 between opposed cover plates 58, FIG. 6, maintained in parallel relation with the assistance of spacers 59, and nut and bolt assemblies 47 as seen in FIG. 1. Projecting end 57 of sleeve 56 is received in opening 61 of outer plate 58 (see FIG. 2) and is intended to terminate in the plane thereof as seen in FIGS. 6, 7. Pinion plate 40 is received in annular recess 65 of ratchet wheel 50 (FIG. 2) in the normal position of assembly as seen in FIGS. 6, 7. In such position grooves 47 of pins 46 are desirably located in a plane coplanar with disc 63 of plate 40 (see FIG. 2) between adjacent surfaces of plate 40 and ratchet wheel 50 (FIGS. 6, 7). Following mounting of wheel 50 between the plates 58, a cover plate 60 (FIG. 1) is secured to threaded end 62 of pinion 32 by nut 67 which may be secured in place by a cotter pin or the like.

Pinion end bearing plate 70, see FIG. 2, is centrally apertured similarly to plate 40 so as to be slidably keyed to the outer periphery of the teeth 30 of the pinion 32 and is also mounted by means of bearing hub 71 in a receiving opening 73 of wall 16 mounted on the jack base 12. As seen in FIG. 3, plate 70 is traversed by the pinion threaded left end 62L, and nut 67L secures cover plate 60L over the outer surface of end plate 70. Thus pinion 32, rachet wheel 50 and pinion plates 40 and 70 are normally rotatable as a unitary member, and the jack plates 14, 16 support the entire assembly by means of the bearing hubs 71, 41 of the pinion plates 70 and 40 respectively.

It is thus seen that the pinion 32 traverses the two vertical parallel walls 14 and 16 mounted on the jack base 12 at its left portion, meshes with the teeth of rack 24 by means of teeth 30, rotates with pin-connected gear 50 while connected therewith through pins 46, and supportingly engages the plates 58 at its right end as seen in FIG. 3. Pivotally mounted between opposed wall portions in a recess of rack 24 is a suspended rail-engaging toe member 72 more clearly seen in FIGS. 1, 2, 4 and 5. The toe is supported by a pin 74 (FIG. 1) mounted between opposed wall portions of the curved rack member 24. The walls terminate at a rack edge face 75 oppositely disposed to rack teeth 28.

Figure 4:
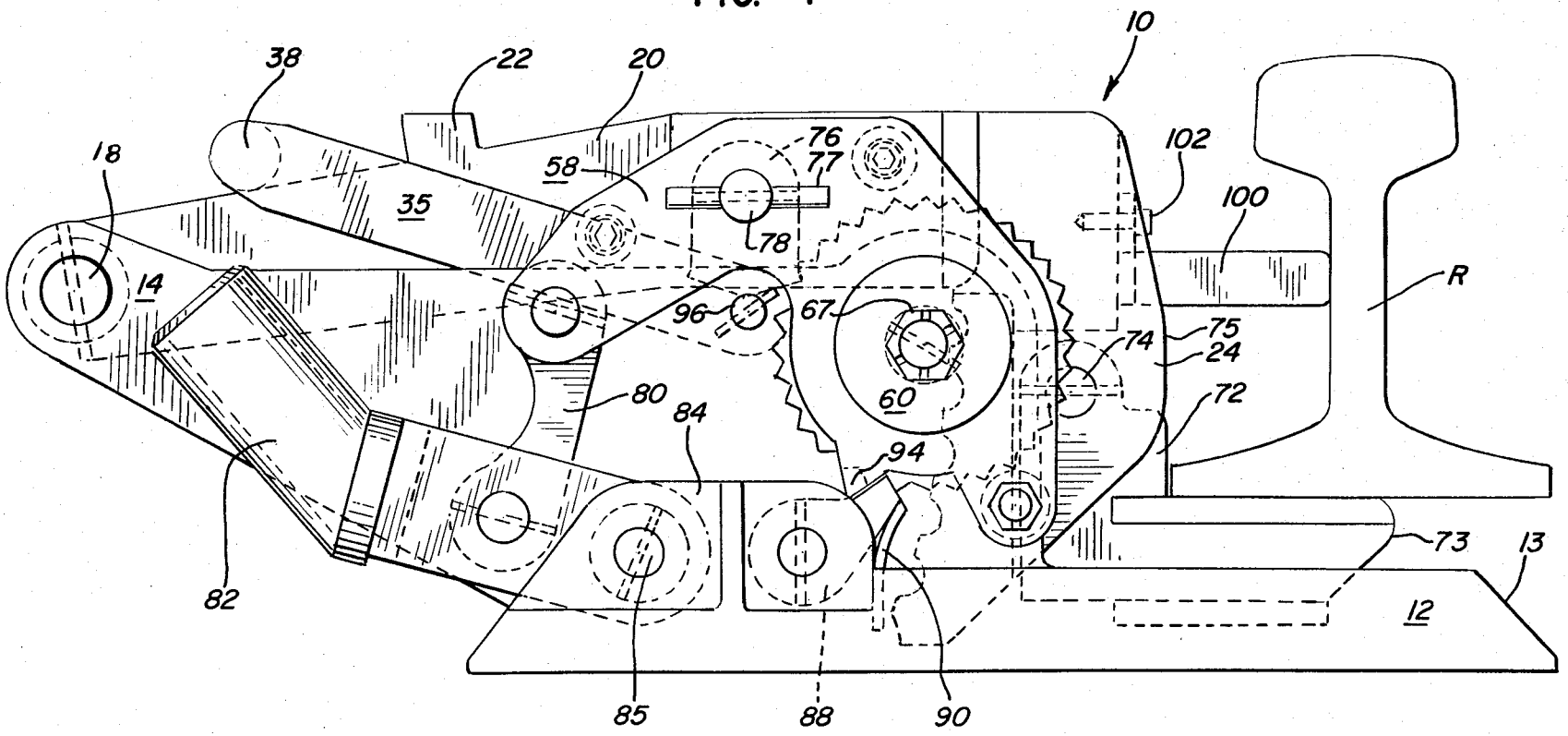
FIG. 4 is a side elevational view of the jack of FIG. 1 illustrating the lifting jack prior to initiating lifting action upon an engaged rail member.
Figure 5:
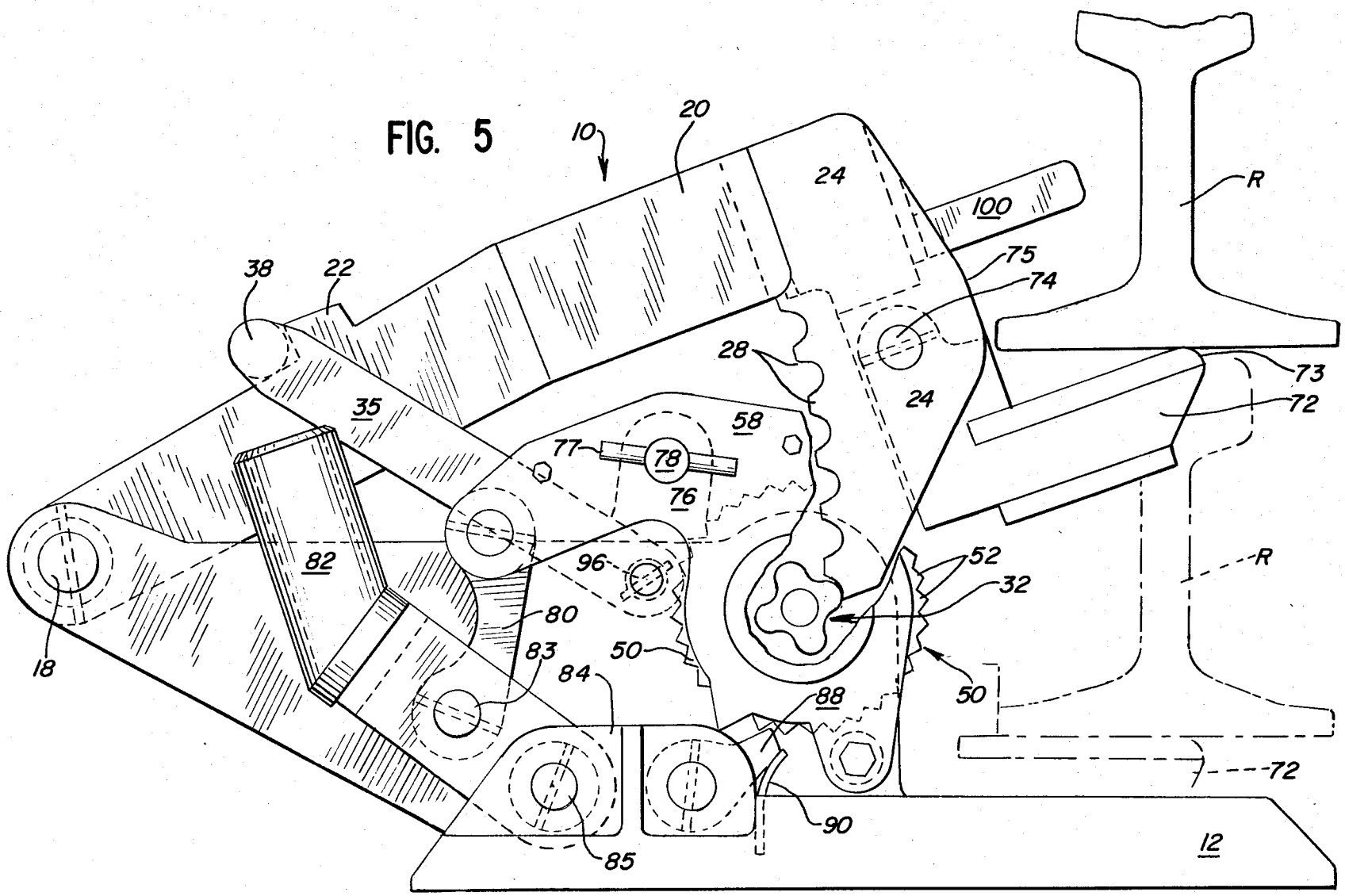
FIG. 5 is a side elevation view, partly broken away, illustrating the jack construction in its maximum lift position and at the instant of manually directed jack collapse.

Ratchet wheel 50 is driven by a driving pawl 76 pivotally mounted between the walls 58 in the manner most clearly seen in FIG. 5. The wall assembly 58 and the driving pawl 76 which is mounted on support pin 78 traversing the two walls 58, move relative to the pinion 32 and independently thereof, upon actuation of the wall assembly and driving pawl 76 by means of a link 80 connected to a bifurcated lever element and drive socket 82. Link 80 pivotally engages element 82 at pin 83 and the walls 58 at pivot pin 89 (FIGS. 1, 4, 5). A manually actuated lever disposed in socket 82 forces the ratchet gear 52 to rotate in a counter clockwise direction as illustrated in FIGS. 1, 2, 4 and 5, simultaneously driving the pinion 32 to which connected by means of the shear pins 46. Rotation of the pinion 32 results in simultaneous elevation of the pinion-driven curved rack 24 of the jack.

The rack 24 thus pivotally moves about stationary pivot pin 18. A lever inserted in receiving opening 84 of socket 82 may reciprocally move the bifurcated connection and attached link 80 in the vertical plane, resulting from a series of up and down strokes. The ratchet wheel 50 is positively driven in a counter clockwise direction as the lever is moved downwardly by driving pawl 76. The broken-away, side elevational view of FIG. 5 illustrates driving pawl 76 in engagement with the ratchet wheel 50 of the jack and pinion 32 in engagement with rack 24 at the instant at which the jack rack 24 is at its maximum elevated position. It will be noted from FIG. 5 that in such position further actuation of the lever socket 82 will be incapable of further moving the rack 24 in a vertical direction inasmuch as bail 38 of handle 30 is in engagement with the stop boss 22, thereby preventing further upward movement of the curved rack 24.

It should be noted at this time that by utilization of curved rack 24 and the disposition of the rack teeth 28 along an arcuate path, the provided jack 10 is able to effect a desired vertical rise of engaged objects such as a rail to be lifted, while at the same time providing a minimum collapsed height such as is apparent from FIG. 4 in the drawing. It will be noted from FIG. 4 that in the collapsed position, the height of jack 10 is less than that of a rail R in the normal position of jack use. If a straight rack were employed in place of the curved rack 24 to provide an equivalent lift, the jack in the collapsed state would be higher than that illustrated in FIG. 4 and, accordingly, provide an obstacle when employed for jack repair as the increased height would provide an object to be struck by a moving train. By virture of the low profile of the jack 10, apparent from FIG. 4 the same is able to lift heavy loads and in the collapsed state, remain in place on a track, and yet provide no obstacle to a train moving over the rail engaged thereby.

Thus, the provided jack has a built-in structural safety mechanism preventing upward movement of the curved rack relative to the drive pinion 32 prior to disengagement of the rack 24 from the pinion 32. The bail-boss engagement of FIG. 5 occurs at the end limit of the rack upward travel, and prevents damage to the various jack components.

It is apparent from the various views of the drawing that the drive pawl 76 is actuated by a lever inserted in socket 82 which is in turn pivotally mounted on supporting bracket 84 on the base 12 by means of pin 85. This structure is most clearly seen in FIG. 1.

Stop pin 96 (FIGS. 4, 5) defines the end limit of the downward movement of the lever and receiving socket 82 as well as the wall assembly 58 having the drive pawl 76 mounted thereon. Stop pin 96 engages the bottom of drive pawl 76 at the completion of a lever rack-elevating stroke. Spring loaded retaining pawl 88, see FIGS. 4, 5, engages a tooth 52 of the ratchet wheel 50 preventing clockwise rotation thereof at the completion of a lever stroke. Such rotation is induced by the load such as a rail R supported on toe 72 having a tendency to force the supporting rack 24 to move in a downwardly direction, simultaneously forcing the pinion 32 to rotate clockwise as illustrated in FIG. 5. Spring 90 retains the retaining pawl 96 in engagement with the ratchet wheel 50 preventing clockwise movement thereof in opposition to the load imparted by the supported rail, toe and rack.

If it is desired to lower the rack 24, toe 72, and the supported rail R from the elevated position of FIG. 5, a slight lever-applied lifting force is applied to the socket 82 until drive pawl 76 is located relative to the ratchet wheel 50 to allow the retaining pawl 76 to be manually rotated 180° by pin 77 into the position shown in FIG. 1. The lever and lever-receiving socket 82 are then driven downwardly into the position of FIG. 1 with no force applied to the ratchet wheel 50.

It will be noted that in the position of FIG. 1 a disengaging tooth 94 of each wall 58 forces retaining pawl 88 pivotally mounted on mounting bracket 86 in opposition to the spring 90, out of engagement with the ratchet wheel 50. As a result, there is no resistance to the clockwise rotation of the ratchet wheel 50 and the pinion 32 engaging the rack 24 so that the rack and any supported load is allowed to fall by gravity, substantially instantaneously, so that the rack 24 and toe 72 assume the lowered position of FIG. 4.

It is thus seen from the foregoing that stop pin 96 illustrated in FIGS. 4, 5 of the drawing normally functions as a stop, engaging the bottom edge of the drive pawl 76 in the course of terminating a downwardly applied lever stroke. Pin 96 thus functions to define the extent of the ratchet wheel movements in a counter clockwise direction for load elevating result. The retaining pawl 88 subsequently prevents reverse movement of the ratchet wheel 50, and the jack construction is ready for a new lever downward stroke. As above noted, in FIG. 1 the jack 10 has initiated its downward descent as the drive pawl 76 having been reversed 180° will not engage the stop pin 96, thereby allowing the retaining pawl engaging tooth 94 to move the retaining pawl 88 from its normal stopping function into the retracted position in FIG. 1 in opposition to the leaf spring 90.

The provided jack is thus able to efficiently lift a supported rail R mounted on the toe 72 of the jack in the manner of FIG. 4 after the toe has been desirably positioned beneath the rail in the manner illustrated in FIG. 4. It will be noted from FIGS. 1 and 4 that toe 72 is received in recess 91 of jack base 12 to facilitate movement of the toe beneath a rail to be elevated and thereby minimize the amount of the ballast which must necessarily be removed. Beveled edge 13 of jack base 12 facilitates insertion of the base and toe beneath a rail. The desired disposition of the surface of the toe 72 relative to the undersurface of the rail R is facilitated by the spacer bar 100 which is supported by rack 24. The spacer bar 100 may be secured to a surface of the rack 24 by a screw 102 (FIG. 2) or cast integrally therewith.

It should be noted from the curved nature of the rack 24 that as it proceeds upwardly in the vertical plane from the position of FIG. 4 to the position in FIG. 5, it will follow a curved path. As a result, the point of engagement with the undersurface of the rail R will normally move to the left. As illustrated in FIGS. 4 and 5 as the rail can remain in substantially the same vertical plane, if loosely secured to track ties on which the retaining spikes have been loosened.

It will be noted from FIG. 5 that in the elevated position curved edge 73 of the toe will effect a substantially line contact with the under surface of the supported rail as it slidably moves relative to the rail undersurface in the course of following its arcuate path whereas the rail remains in the same, substantially vertical plane if secured at its ends as above indicated.

The inherent safety feature of the provided jack 10 will come into play in the event an elevated rail as in the position of FIG. 5 is left unattended by workmen on the site of track repair, or in the event a train suddenly appears so that the workmen have inadequate time to lower the jack to its retracted position in the manner previously described by disengaging retaining pawl 88 from the ratchet wheel 50. Under such circumstances the weight of the oncoming train moving along the track will eventually be transmitted to the elevated, supported rail at which time the train weight will effect shear stresses in the shear pins 46 interconnecting the pinion 32 and ratchet wheel 50. As a result, the shear pins 46 which may be two in number will shear cleanly at notches or grooves 47, separating the pinion from the ratchet wheel 50 which is retained in fixed position by retaining pawl 88 as seen in FIG. 7. However, after the shear pins have failed in shear along the grooves 47 the pinion 32 is free to rotate freely relative to the supported rack and load, and the jack toe and the rail will instantaneously be lowered into the position of FIG. 4. Accordingly, at the instant the oncoming train is over the jack construction, the same will be in a lowered position and provide no obstacle to the moving train. The automatic jack retraction obviates any danger of derailment as may be occasioned by the jack or rail in the elevated position.

The linkage design above described provides mechanical advantage of two and one-half to one. As a result the maximum force applied by means of the lever is maintained at a minimum. The provided jack construction may be of a weight so as to readily be carried by a single workman by means of the handle 36 into desired position. Only a minimum amount of excavation beneath the rail to be elevated is necessary to enable the toe and adjacent base plate portion of the jack to be inserted beneath the rail in the manner illustrated in FIG. 4.

By way of example, a jack construction built in accordance with the foregoing description may safely lift a load of 10 tons and have a compact, closed height of 8 inches while providing a vertical lift of six inches. As the foregoing description has indicated that the lifting rack is pivotally movable about a fixed pivot 18 and the force applying lever which may be five feet in length is similarly moved about a fixed pivot 85 rendering it an easy matter to apply the necessary elevating force at maximum jack load.

The pins interconnecting the pinion plate 40 and the ratchet wheel 50 may vary from 1 to 4 in the example of the drawing and the strength of each pin 46 may be closely regulated by the manufacturer of such pins which are commercially available. Thus, the precise jack load at which the jack will readily and automatically collapse by means of the weight of an approaching train fracturing the shear pin or pins may be accurately controlled. The number 4 of the drawing may obviously be increased or decreased as desired.

It is, of course, apparent that the provided jack may be employed in such manner by utilization of appropriate strength pins so as to never fail in the course of its intended use and as a result, the jack release and retraction into the collapsed position will always be occasioned by the driving pawl reversal out of engagement with the ratchet wheel 50 in the manner above described. In such instances the jack will be used so as not to require automatic jack collapse.

It is believed apparent that a number of modifications is suggested to men skilled in the art. As the surface of the rail-supporting toe 72 must slidably engage the bottom surface of the rail, it is apparent that a roller member may be substituted for curved edge 73 so as to provide a minimum of frictional resistance in the course of the rail slidably moving relative to the supporting toe.

It is apparent from FIGS. 6 and 7 and the remaining drawing figures that the various jack components are readily assembled by simple slidable interfitting and pin connections. Following shear pin failure as illustrated in FIG. 7, the jack elements may be readily disassembled for fractured pin removal and insertion of a desired number of new pins.

Also, it is believed apparent that the provided construction illustrated in various figures of the drawing is presented by way of illustration only. The number of discrete parts may vary as by integrally casting a plurality of parts into a single unit where appropriate. Cotter pins or equivalent means may be employed where appropriate in the above-described jack to retain a desired assembled relation between shafts and members mounted thereon in a manner well known in the art. As an alternative to retaining pins 46 by a press fit in pinion bearing plate 40, a set screw extending thereon in a manner well known in the art. As an alternative to retaining pins 46 by a press fit in pinion bearing plate 44, a set screw extending from a flat in the plate periphery may lock the pin in its aperture 44. Also, the pins may be precisely fitted in receiving apertures 44 and 54 of the plate 40 and wheel 50 and retained in position by adjacent surfaces of jack elements preventing movement of the pins from their apertures. The material of composition of the jack elements may, of course, be as desired and are dictated by the desired strength and may be formed of steel and various metal alloys so as to provide the desired combination of strength and weight. The pinion bearing plates are formed of metals providing the necessary ability to rotate without excess heat generation so as to avoid binding at the bearing points.

It is intended that this invention be eliminated only by the scope of the intended claims.

What is claimed is:

1. A readily collapsible jack construction particularly adapted for use in railway track maintenance comprising a curved rack pivotally movable about a stationary pivot from a lowered position to an elevated position; railway track engaging means supported by said rack movable with said rack into the elevated position; a rotatable pinion engageable with said rack for moving said rack into the elevated position; rotatable drive means in adjacent relationship with said pinion and rotatable with said pinion about a stationary axis of rotation; means adapted to fail in shear interconnecting said pinion and rotatable drive means whereby they may rotate as a unit in the normal course of rack elevation; failure of the means adapted to fail in shear allowing said rack to substantially instantaneously fall into the lowered position; said rack in the lowered position lying below the level of track to be engaged by the track-engaging means in the normal course of jack use.

2. A mechanical jack construction comprising a load-supporting rack adapted to rise in the normal course of jack lifting action; rotatable pinion means engaging said rack; spaced plates keyed to said pinion means and rotatable therewith having bearing positions; supporting wall means 16, 14 having apertures in which the plate bearing portions are supportingly received; a base supporting said wall means; means adapted to fail when a predetermined load is supported by said jack mounted in one of said spaced plates; a ratchet wheel rotatable with said rotatable pinion means and connected thereto by the means adapted to fail, and means for applying forces to said ratchet wheel to rotate said pinion means and provide a jack lifting action; said rack dropping substantially instantaneously from an elevated position upon failure of the means connecting said one spaced plate and said ratchet; said pinion means and ratchet wheel rotating independently of each other following failure of the means adapted to fail under load.

3. The jack construction of claim 2 in which said rack is supported by means of an arm pivotally mounted about a fixed pivot on said supporting wall means, and a load engaging means is pivotally and supportably mounted on said rack.

4. The jack construction of claim 3 in which said means adapted to fail under a predetermined load comprise shear pins having an annular groove disposed in a plane between adjacent surfaces of said ratchet wheel and said one spaced plate.

5. The jack construction of claim 4 in which said pinion means has a cylindrical end portion and said ratchet wheel has a central opening adapted to receive said cylindrical portion whereby said ratchet wheel is supported by said pinion and whereby said pinion means may rotate relative to said ratchet wheel upon failure of said shear pins.

6. The jack construction of claim 2 in which apertured cover plates engage opposed side surfaces of the rotatable ratchet wheel and have a pawl for rotatably driving said ratchet wheel pivotally mounted therebetween; said walls being rotatably movable as a unit in opposite directions about the axis of said pinion means extending through aligned apertures of said cover plates.

7. The jack construction of claim 6 in which a connecting link pivotally engages the cover plates at a first link end, and a reciprocating drive means pivotally mounted on said jack base pivotally engages said connecting link at a second link end.

8. The jack construction of claim 7 in which said drive means includes a bifurcated portion pivotally engaging said connecting link and having one end portion pivotally mounted on said jack base; said drive means also including a lever-receiving socket whereby said connecting link and cover plates connected thereto may be reciprocally actuated in the vertical plane relative to said jack base.

9. The jack construction of claim 6 in which a stop pin is mounted on one of said supporting wall means and engages said drive pawl after rotatably driving said ratchet wheel through a predetermined arc in one direction of rotation.

10. The jack construction of claim 9 in which a spring biased retaining pawl is pivotally mounted on said jack base preventing rotation of said ratchet wheel after said drive pawl drives said ratchet wheel through a predetermined arc.

11. The jack construction of claim 10 in which at least one of said cover plates has a projection thereon for removing said retaining pawl from engagement with said ratchet wheel upon actuation of said drive link; said projection being located on said plate so as to be engageable with said retaining pawl after the driving pawl is pivoted between said cover plates so as not to engage said stop pin upon actuation of said drive means; disengagement of said retaining pawl from engagement with said ratchet wheel enabling the rack to substantially instantaneously descend from an elevated position.

12. The jack construction of claims 2, 11 or 1 in which said jack in the collapsed state has a height less than the height of a rail of a track when said jack is in a position of use for lifting such track.

13. The jack construction of claim 2 in which a handle for carrying said jack has arms pivotally mounted on said supporting wall means and said rack comprises a portion of an arm pivotally supported between said wall means; said arm having a stop boss disposed in a longitudinal surface of said arm; said handle arms straddling said arm and being connected by a bail portion which slidably engages said longitudinal surface during normal jack lifting operation and engages said stop boss when said rack has extended to its maximum height so as to prevent further vertical movement of said arm.

* * * * *